United States Patent [19]

Rastorguyeff

[11] 4,101,121

[45] Jul. 18, 1978

[54] DOCUMENT FOLDING APPARATUS

[75] Inventor: Andrew Wladimir Rastorguyeff, Norwalk, Conn.

[73] Assignee: Pitney-Bowes, Inc., Stamford, Conn.

[21] Appl. No.: 766,899

[22] Filed: Feb. 9, 1977

[51] Int. Cl.[2] ..... B65H 45/14

[52] U.S. Cl. ..... 270/68 A

[58] Field of Search ..... 270/68 A

[56] References Cited

U.S. PATENT DOCUMENTS 3,021,134 2/1962 Appell ..... 270/68 A 3,516,655 6/1970 Schmeck ..... 270/68 A

*Primary Examiner*—Edgar S. Burr

*Assistant Examiner*—A. Heinz

*Attorney, Agent, or Firm*—Peter Vrahotes; William D. Soltow, Jr.; Martin D. Wittstein

[57] ABSTRACT

A document folding apparatus is disclosed wherein means is provided for accomodating documents of various thickness. After the document thickness is determined, means is provided for actuating linkage means for varying the distance between rollers of the apparatus for accomodating the document thickness.

8 Claims, 1 Drawing Figure

DOCUMENT FOLDING APPARATUS

BACKGROUND OF THE INVENTION

Sheet folding apparatus are known wherein a sheet may be folded into one of a number of configurations. The sheet may have a single fold involving an overlap of one end to another, it may have an accordian fold which is a generally Z-shaped cross-sectional fold, it may have a standard fold wherein two folds are made with one of the panels being inserted in the other two, or it may have a double fold wherein the sheet is first folded in half and then folded in half once more to form four overlapping panels. Examples of such apparatus may be found in U.S. Pat. Nos. 3,495,818 and 3,516,655, which are assigned to the assignee of this patent application.

Although prior folding apparatus work well for single sheets or for even double sheets, a problem arises when one wishes to fold a document containing a plurality of sheets thereby obtaining a relatively great thickness in the folded document. The particular problem arises in that the space between the rollers of the apparatus cannot accomodate these various thicknesses because if the rollers are too far apart, they could not conveniently transport single sheets but if they are too close together, they could not accomodate a document having multi-sheets as the same would tend to wrinkle while passing between the rollers. It obviously would be desirable to have a document folding apparatus which would be capable of accomodating documents of different thicknesses, especially when succeeding documents fed into the apparatus are of different thicknesses.

SUMMARY OF THE INVENTION

A document folding apparatus is provided having a pair of drive rollers and a plurality of idler rollers associated therewith. A pair of buckle chutes are positioned in the vicinity of the drive and idler rollers as is well known in the art so that a variety of folds may be made on documents by positioning a stop in each of the buckle chutes. Means is also provided through linkage members to vary the distance between one drive roller and an idler roller and the same drive roller and a second idler roller, each of the two idler rollers being associated with one of the buckle chutes, respectively. A sensing means may be provided to measure the thickness of a document as it is being supplied to the document folding apparatus. In response to this measurement, a drive means acts on the support members of the variable idler rollers so as to vary the distance between these idler rollers and their associated drive roller to provide sufficient space to allow a folded document to be conveyed conveniently.

BRIEF DESCRIPTION OF THE DRAWING

The single FIGURE of the drawing shows a longitudinal cross-sectional view of a document folding apparatus that incorporates the features of the instant invention.

DETAILED DESCRIPTION OF THE PREFERRED EMBODIMENT

Figure 1:
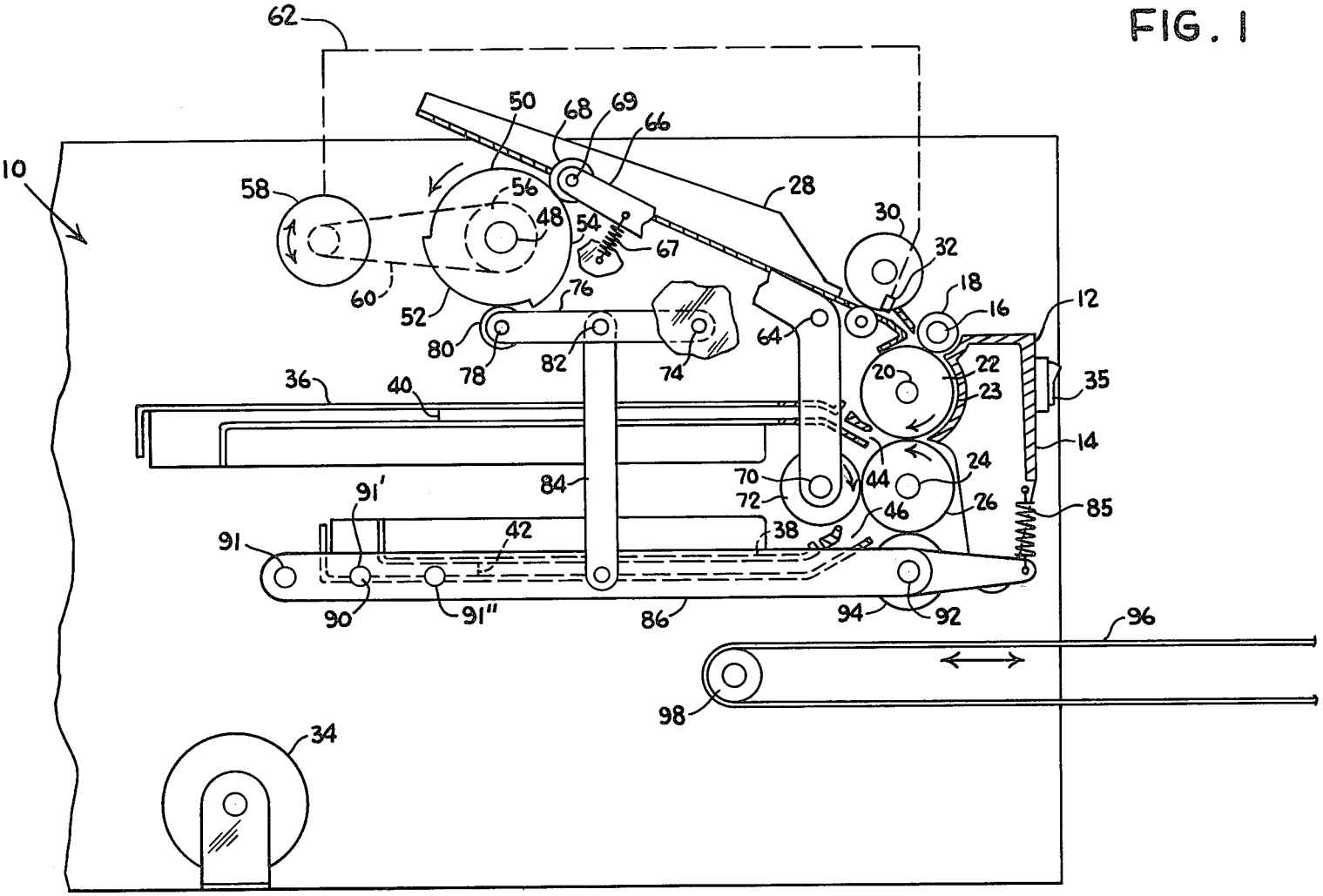

Referring now to the drawing, a document folding apparatus is shown generally at 10 and has a housing 12 which supports a frame 14 therein. A first shaft 16 is supported within the housing and supports a laterally extending idler roller 18. Another shaft 20 is supported within the housing and supports a drive roller 22 adjacent a curved portion 23 of the frame 14. This shaft 20 is parallel to and in alignment with another shaft 24 that also supports a drive roller 26 which is in alignment with and adjacent to the roller 22. Disposed within the housing 12 and above the frame 14 is a feed table 28 which has a main feed roller 30 associated therewith. The feed table 28 may be of the type which is described in U.S. Pat. Nos. 3,495,818 and 3,516,655 and the reader is referred to these two patents for details of such a feed table 28 as the same does not form a part of the instant invention and will not be described any further. Located immediately downstream from the feed table 28 is a sensing member 32, such as a feeler gauge, that is able to determine the thickness of documents which are fed from the feed table to the nip of the rollers 18, 22. Such sensing members 32 are well known in the art and will not be described in detail since the same does not form part of the invention. An example of one type of sensing member 32 that could be used would be the combination of a tranducer that would react to the thickness of the documents, a signal amplifier and analog to digital converter that would transmit an amplified signal in digital form to a microprocesser. The microprocesser would accept the signal from the analog to digital converter and compare the received signal with the value previously received and compute the difference. Upon determining the difference an appropriate series of pulses would be sent to a motor control that would control the stepper motor 58 referred to hereinafter.

Received within the housing 12 is a motor 34 and a switch 35 which pertrudes from the housing. Although not shown, it is to be understood that the motor 34 and switch 35 are electrically connected and that the motor 34, main feed roller 30 and shafts 20, 24 are mechanically connected to provide drive from the motor 34 to the rollers 22, 26 and 30 under control of the switch.

Disposed within the housing 12 are a pair of longitudinally extending buckle chutes 36, 38 each having longitudinally adjustable stop members 40, 42, respectively. The upper buckle chute 36 has an opening 44 therein which is adjacent the nip of the drive rollers 22, 26. The lower buckle chute 38 has an opening 46 which is adjacent the lower portion of the roller 26.

Disposed above the frame 14 and rotatably received within the housing 12 is a shaft 48 which has a cam 50 located at each of its lateral ends, each cam having a pair of cam surfaces 52 and 54. Attached to the shaft 48 intermediate its end is a gear 56. Supported by the housing 12 is a stepper motor 58 and extending therefrom is a chain 60 which entrains about the gear 56 to drive the shaft 48 and its accompanying cam member 50. An electrical connection 62 is provided between the sensing member 32 and the stepper motor 58 so that the latter may be enabled by the sensor.

Received within the housing 12 is a stationary shaft 64 that has a pair of laterally opposed linkage members 66 pivotally disposed upon and in lateral alignment with the cams 50 thereon. Each linkage member 66 has a roller 68 supported by a pin 69 at one end which engages one of the cam surfaces 54 of a respective cam 50. One end of a spring 67 is attached to each linkage member with the other end secured to the housing 10 for the purpose of biasing each roller 68 toward its associated cam 50. Received within the opposite ends of the linkage members 66 is a shaft 70 which rotatably supports an idler roller 72 that is adjacent the drive roller 26. The opening 46 of the buckle chute 38 is located at the nip of the rollers 26, 72. Preferably, the distance from the shaft 64 to the pin 69 is the same distance as from the shaft 64 to the shaft 70.

Another shaft 74 is supported within the housing 12 and pivotally supports a pair of laterally opposed linkage arms 76. The end of each arm 76 receives a pin 78 that supports a roller 80 which is in lateral alignment with a cam 50 and in engagement with the second cam surface 52 of its respective cam 50. Intermediate the shaft 74 and pin 78 of each linkage arm 76 is another pin 82 which supports a connecting linkage member 84. Secured to each connecting linkage member 84 by a pin 85 is a lever 86 which has three openings 91, 91' and 91'' that receives a pivot stud 90 therein. Each stud 90 may at any one of three locations extend through and be supported by the housing 12 so that it may be placed in one of the three openings 91, 91' and 91'' to thereby vary the pivot point of the levers 86. The opposite end of the levers 86 receive one end of a spring 85, the other end of the spring being supported by the frame 14. Near the opposite end of the levers 86 is a shaft 92 which rotatably supports an idler roller 94, which idler roller is adjacent the drive roller 26. Located below the idler roller 94 is a drive belt 96 trained about rollers 98 which is provided to convey documents away from the folding apparatus 10.

In operation, the switch 35 is turned on to enable the motor 35 thereby providing drive to the drive rollers 18, 22 and 26. A document is fed by the feed table 28 and is sensed by the sensor 32 to determine the thickness of the document. In response to this sensing, the stepper motor 58 will be enabled to be driven in one rotational direction or other if the document being supplied by the feed table 28 has a different thickness than the immediately preceeding document. Upon rotation of the cam 50, the rollers 68 will ride along the first cam surface 54 thereby pivoting the linkage members 66 about the shaft 64. This results in the idler roller 72 being moved relative to the drive roller 26. For example, if the cams 50 are rotated by the motor 58 in a counterclockwise direction as seen in the drawing, the linkage members 66 will be rotated in a clockwise direction and the idler roller 72 moved in a direction away from the drive roller 26 thereby providing increased space between these two rollers. At the same time, the linkage arms 76 are pivoted about the shaft 74 as a result of each roller 80 riding upon the second cam surfaces 52. Once more, if the cam is rotating in a counterclockwise direction, the linkage member 84 will be driven downwardly to pivot the lever 86 about the pivot stud 90 thereby increasing the distance between the idler roller 94 and the drive roller 26. In this way, the variance in document thickness may be accomodated for a given fold. It will be observed that the distance between the idler roller 18 and drive roller 22 and the distance between the drive rollers 22, 26 remains constant. This is possible since no great problem is confronted by thickness variations of documents as they are being fed between these rollers, i.e., the distances between the rollers 18 and 22 and 22 and 26 may be spaced to conveniently handle a variety of thicknesses. On the other hand, after a document has entered the chute 36, becomes folded and then enters the nip between the idler roller 72 and drive roller 26, the thickness will at least double thereby inhibiting the ability to reach a satisfactory compromise in the distance between these rollers. This is why the distance between these rollers 22, 26 must be varied. The same is also true of the distance between idler roller 94 and drive roller 26 in that at this junction, the documents may be as much as four times greater in thickness than the unfolded document which entered the apparatus 10.

As indicated previously, the folder 10 is capable of producing a number of different folds by adjustment of the stop members 40, 42. Because of this, another adjustment of the distance between the idler roller 44 and the drive roller 26, is required. For example, in a single fold the same distance is required between rollers 26 and 72 and between rollers 26 and 94. Where another is to take place through cooperation with the chute 42, the distance between rollers 26 and 94 must be greater than the distance between rollers 26 and 72 to accomodate the extra fold. To accomplish this, not only is the stop member 42 of chute 38 adjusted, but the pivot stud 90 would be moved from opening 91 to opening 91'. For a double fold, the pivot stud would be moved to opening 91''. In this way the additional space between rollers 26, 94 is provided when an additional fold is to take place in cooperation with the chute 38.

Although the folder 10 is shown utilizing a feeler gauge 32 and stepper motor 58, it will be appreciated that the document thickness may be measured before being placed on the feed table 28 and the cam manually rotated in accordance with this mesurement.

What is claimed is:

1. A document folding apparatus comprising:

a. a longitudinal extending housing;

b. a pair of drive rollers disposed within said housing adjacent one another to form a nip therebetween, the axis of said drive rollers being parallel to one another and disposed one above the other;

c. means for providing drive to at least one of said drive rollers;

d. a first idler roller supported by said housing above the upper roller of said pair of drive rollers to form a nip therebetween;

e. a first buckle chute having an adjustable stop supported within said housing and having an opening adjacent the nip between said drive rollers;

f. means for delivering a document between said first idler roller and said upper drive roller;

g. a second laterally extending idler roller disposed within said housing below said first buckle chute and in horizontal alignment with the lower drive roller of said pair of driver rollers to form a nip therebetween;

h. a second longitudinally extending buckle chute having an adjustable stop therein supported within said housing below said first buckle chute and said second idler roller and having an opening adjacent the nip of said lower drive roller and said second idler roller;

i. a third laterally extending idler roller located below and ajacent said lower drive roller; and j. means responsive to the thickness of a document for varying the distance between said second idler roller and said lower drive roller and said third idler roller and said roller lower drive roller prior to the delivery of a document to said second roller and said lower drive roller.

2. The apparatus of claim 1 including means for measuring the thickness of a document being delivered to the nip between said first idler roller and said upper drive roller.

3. The apparatus of claim 2 wherein said distance varying means is responsive to said document thickness measuring means.

4. The apparatus of claim 1 including second means for varying the distance between said third idler roller and said lower drive roller.

5. A document folding apparatus comprising:

a. a longitudinal extending housing;

b. a pair of drive rollers disposed within said housing adjacent one another to form a nip therebetween, the axis of said driver rollers being parallel to one another and disposed one above the other;

c. means for providing drive to said drive rollers;

d. a first idler roller supported by said housing above the upper roller of said pair of drive rollers;

e. a first buckle chute having an adjustable stop supported within said housing and having an opening adjacent the nip between said drive rollers;

f. means for delivering a document between said first idler roller and said upper drive roller; means for delivering a document from said first idler roller and said upper drive roller toward said nip between said drive rollers;

g. a shaft rotatably supported within said housing and having a cam means located thereon, said cam means having first and second cam surfaces;

h. a pivot shaft located within said housing intermediate said drive rollers and said cam means, said pivot shaft rotatably supporting a first linkage member having two ends with a roller located at each end thereof, a first of said first linkage member rollers being in engagement with said first of said cam surfaces and the other of said linkage member rollers being a laterally extending idler roller located adjacent the lower roller of said pair of drive rollers and below said first buckle chute;

i. a second pivot shaft disposed within said housing and rotatably supporting a linkage arm which has a roller at one end thereof, said linkage arm roller being in engagement with said second of said cam surfaces;

j. a connecting linkage member pivotably supported by said linkage arm intermediate said linkage arm roller and said second pivot shaft;

k. a lever pivotably supported by said connecting linkage member and having an idler roller at one end thereof which is adjacent and below the lower drive roller of said pair of drive rollers, and a pivot member at its opposite end; and l. a second longitudinally extending buckle chute having an adjustable stop therein supported within said housing below said first buckle chute and having an opening adjacent the nip of said lower drive roller and said lever idler roller.

6. The apparatus for claim 5 including means for measuring the thickness of documents being delivered and means for rotatably driving said cam means in response to said thickness measuring means.

7. The apparatus of claim 6 wherein said pivot member of said lever is adjustable to vary its distance from said connecting linkage member.

8. The apparatus of claim 6 including biasing means engaging said linkage arm to urge said linkage arm roller toward said lower drive roller.

* * * * *